United States Patent [19]

Patzlaff

[11] 4,225,424

[45] Sep. 30, 1980

[54] HYDRODYNAMIC BLUEBERRY SORTING

[75] Inventor: Albert W. Patzlaff, South Haven, Mich.

[73] Assignee: Blueberry Equipment, Inc., South Haven, Mich.

[21] Appl. No.: 962,381

[22] Filed: Nov. 20, 1978

[51] Int. Cl.[2] ..... B07C 5/02

[52] U.S. Cl. ..... 209/3.1; 209/173; 209/645; 209/932

[58] Field of Search ..... 209/3.1, 932, 162, 172, 209/173, 208, 645

[56] References Cited

U.S. PATENT DOCUMENTS

| | | | |
|---|---|---|---|
| 1,681,627 | 8/1928 | Sawyer | 209/173 |
| 2,530,676 | 11/1950 | Berg et al. | 209/173 |
| 2,554,495 | 5/1951 | Key | 209/173 |
| 2,976,992 | 3/1961 | Bloch | 209/162 X |

*Primary Examiner*—Allen N. Knowles

*Attorney, Agent, or Firm*—Price, Heneveld, Huizenga & Cooper

[57] ABSTRACT

Blueberry sorting, i.e. classifying, and apparatus therefor, to separate ripe berries from unripened berries and stems, by dynamically immersing all of the berries beneath the surface of a water bath, the unripened berries being controllably allowed to rise to float on the surface of the bath, the ripe berries being deposited on a submersed conveyor and conveyed out of the bath to a separate location. Berry immersion is achieved hydrodynamically by a downward stream of water which propels the berries down to cause release of gas bubbles on the ripe berry surfaces, carry them through a flow zone to the conveyor and then recirculate.

2 Claims, 1 Drawing Figure

HYDRODYNAMIC BLUEBERRY SORTING

BACKGROUND OF THE INVENTION

This invention relates to sorting, i.e. classifying, of blueberries to separate ripe berries from unripened berries.

It is known that ripe blueberries have a specific gravity greater than that of water and that unripe berries have a specific gravity less than that of water. A common practice when harvesting blueberries is to pour the ripe and unripe mixture of blueberries into a tank of water to not only wash them, but also cause ripe berries to sink and green or unripened berries to float on the surface to be skimmed off and separated. A difficulty experienced is that some of the ripe berries do not readily sink but rather remain floating to be skimmed off and discarded with the unripened fruit, resulting in losses. Using this practice, the tank also tends to become filled with berries, a condition which prohibits effective classification. And basically, the process is only partially effective unless performed very slowly and with relatively small batches of berries. Even then, there is little control over those berries not fully ripe but not really green. Such berries are typically sour but flavorful and highly valuable for use in pies or the like. It would be desirable to be able to controllably separate fully ripe berries from those not fully ripe, and to further separate green berries and stems.

SUMMARY OF THE INVENTION

Hydrodynamic blueberry classification or sorting is achieved by dynamic immersion of the mixture of ripe, and partially ripe, and green berries to a substantial depth in a vessel such that the gas bubbles on the ripe berries are separated therefrom, allowing the ripe berries to remain immersed and settle in the vessel, while the unripened berries are buoyed to the surface to be skimmed off. The dynamic immersion of the ripe berries releases air bubbles that form around the characteristic "bloom" or white dust on the berry surfaces that engage the water and form at the depression where the stem attaches to the berry. This "bloom" is the coating that gives the blueberry its distinctive coloring. The water in the tank is circulated using fresh incoming water for propulsion, in a pattern which conveys the fruit in a steady flow through progressive zones of the vessel, as well as immersing the berries. The ripe berries are deposited onto a conveyor, preferably an open mesh belt to which the berries cling, to be separately removed from the vessel.

The vessel has, in addition to the immersion zone and a flowing separation zone, a quiescent zone separated by a dam, where partially ripe fruit can be gently floated away from fully ripe fruit.

The invention enables continuous, effective separation of berries without significant cost, while the berries are thoroughly washed. Control of the dynamic flow rate enables the operator to regulate the separation of green berries and stems from partially ripened berries, and both of these from fully ripened berries. This can be done even though the specific gravity of the berries varies from species to species. These and other features, advantages, and objects will be apparent from the following detailed description.

BRIEF DESCRIPTION OF THE DRAWING

The FIGURE is a sectional, elevational, partially schematic view of the apparatus showing the invention.

DESCRIPTION OF THE PREFERRED EMBODIMENT

Figure 1:
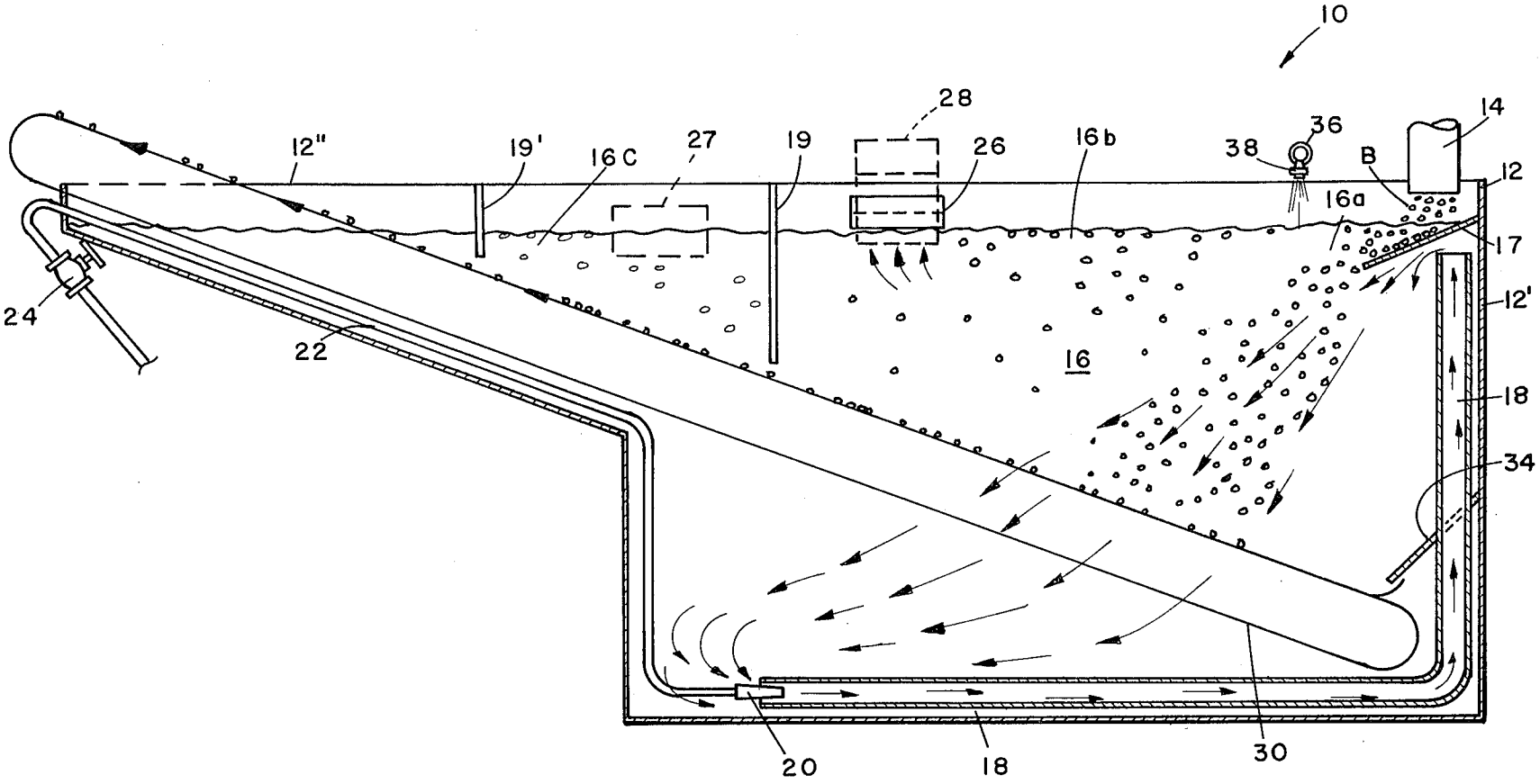

The depicted apparatus 10 includes a vessel or tank 12 preferably having one end portion 12' which is deeper and an opposite end portion 12" which has a decreasing depth to resemble a pan handle, i.e. becomes increasingly more shallow away from the deep end. The vessel retains a water bath 16. At the side of the deep end portion opposite the shallow end portion is a berry entry and immersion zone **16*a*. In this zone is located a berry feed entry chute 14 for feeding the harvested mixture of ripe and unripened (including green and partially ripened) blueberries down into aqueous bath 16. The berry feed means 14** may assume several different forms other than the particular tubular shaped conduit depicted, e.g. a trough, a conveyor, or other equivalent.

As depicted, immediately beneath the feed means to the bath is means for creating a downwardly oriented, berry entrainment and immersion water current. The berries are immersed by a diagonally downward stream of water, the flow of which is represented in the drawing by a series of arrows. This downward outward flow diagonally of the vessel is caused in the embodiment depicted by upward jets of water being deflected back down by the underside of a sloped deflector panel 17 secured to the side wall of tank 12 and oriented diagonally downwardly from this wall at an acute angle toward the opposite lower side of this end portion of the tank. It is positioned between the berry feed means 14 and the outlets of a series or plurality of like rising water spouts or pipes 18 arranged side-by-side across the width of the vessel. The berries fall onto this panel and roll downwardly toward the outer edge thereof. The upper outlet ends of the recirculatory conduits or pipes 18 for the water are directed at the panel underside so that the water flow is deflected outwardly and downwardly along the underside of the panel. Thus at the outer edge of the panel, the water stream encounters and entrains the advancing blueberries to propel them down toward the bottom of the tank. Projecting into the respective opposite ends of conduits 18 are nozzles 20 on the ends of fluid supply pipes 22 controlled by a suitable valve 24 common to them and connected to a source of fluid, i.e. water or air (not shown). The ejection of fluid from nozzle 20 causes entrainment of water from bath 16 into pipes 18 from the lower corner of the portion 12' of the vessel opposite the upper corner zone where the berries are entrained by the water jets. This causes continuous, smooth circulation of the bath water so that, not only does the recirculating water immerse the berries, but also conveys them downwardly through a flow zone **16*b* towards a conveyor. The flow rate thereof can be regulated for rising and separation of green berries and stems by controlled velocity conveyance of the immersed berries. The partially ripe and ripe berries are conveyed by belt 30 past a vertical dam panel 19 positioned near the shallow end of the tank, transversely of the tank. On the opposite side of dam 19 from the dynamic recirculatory zone 16*b* is a relatively static or quiescent zone 16*c* through which the partially ripe and ripe berries are conveyed, and at which the partially ripe berries can be separated from the ripe berries by floating to the top. This occurs here since, although the specific gravity of the partially ripe berries is less than that of the bath, it is sufficiently close that the dynamic downward water flow in zone 16b prevents them from rising. However, in the quiescent zone 16c of the bath, they rise to separate from the fully ripe berries which have a specific gravity greater than that of water. A second vertical dam panel 19' is spaced from the first one 19 on the opposite side of zone 16c. Panel 19'** extends down into the bath also, terminating above the conveyor. Its purpose is to prevent the partially ripe floating berries from migrating to the place where the conveyor projects out of the bath, so as to prevent such berries from being picked up by the conveyor.

The maximum level of water in the vessel is determined by an overflow outlet 26 near the top of the tank such that constant inflow of water through pipe 22 is matched by outflow through this outlet. At this outlet is mounted a conventional power skimmer 28 which constitutes a form of conveyor. If the fluid from pipe 22 is air, fresh water can be added through another inlet.

The recirculatory conveyor 30 extends across the vessel near the bottom, from beneath berry inlet 14, diagonally upwardly across the vessel, beneath the water level, to emerge above the liquid out of the vessel for continuously discharging ripe berries. This conveyor in effect forms a diagonal bottom for the berries in the vessel, with berries being prevented from falling off the lower end of the conveyor by panel 34. This conveyor is a recirculatory belt of open mesh, with openings allowing the circulating water to flow down through it while being small enough to prevent berries from passing through. A belt of steel mesh or the like is effective, as is a mesh of plastic links. The latter is preferred. The belt is mounted on end pulleys or the equivalent and powered to cause the upper surface to travel upwardly and outwardly of the tank.

Adjacent the berry inlet is preferably also a water spray unit 36 which may include a plurality of downwardly oriented spray nozzles 38 for ejecting water toward the water surface of the bath. This supplements the recirculatory stream of water flowing from pipes 18 and deflected by panel 17.

During operation of apparatus 10, fluid such as water is introduced through pipe 22 by opening valve 24 to cause the water bath level to rise until it flows constantly out of overflow opening 26. This water from nozzles 20 through a plurality of conduits 18 across the vessel entrains water from the bath, the combination flowing upwardly out of the mouths of conduits 18 against panel 17 to be deflected downwardly and outwardly across the tank in a diagonal direction. The mixture of ripe, not fully ripe, and unripe (i.e. green) harvested berries is introduced to the bath through feed inlet 14 to fall upon panel 17 and roll down off the outer edge thereof. There the berries are entrained by the water stream off the undersurface of panel 17 and propelled down to a significant immersion depth toward the bottom of the vessel. The tiny air bubbles clinging to the characteristic whitish powder or "bloom" on the surface of the ripe berries and at the dimple or recess at the stem area thereof break loose under the pressure and rise. This decreases the buoyancy of the ripe berries such that the combination of their specific gravity greater than that of water and the downward water flow causes them to sink further in the bath. The partially ripened berries can also be caused to remain immersed by control of the downward water flow direction and velocity, even though their specific gravity is slightly less than that of water. Thus, these berries also can be separated from the very lightweight green berries and the stems. The sinking berries ultimately are deposited upon open conveyor 30 by the downwardly flowing water passing through the conveyor. These berries are then conveyed from the bath out the opposite end of the vessel. The immersed green berries and stems have substantial buoyancy because of their specific gravity considerably less than that of water, causing them to rise to the surface and ultimately be skimmed off by skimmer 28 at outlet 26. Hence, the berries are separated in a continuous reliable fashion.

As the ripe and partially ripe berries are conveyed beneath and past the vertical dam panel separating the dynamic flowing zone 16b of the bath from the quiescent zone 16c, the difference in the specific gravities takes effect to cause the partially ripened berries to rise to the surface and float while the heavier ripe berries remain on the conveyor belt to be carried out. This therefore results in a second stage of separation. The floating berries can be skimmed off as at a skimmer 27 depicted in phantom.

The degree of ripeness of the berries at which separation occurs from the green berries and from the fully ripe berries can be regulated by the operator, using the flow rate of the circulatory liquid in the bath.

In a particular installation, it is possible of course to combine the above described features in various ways to achieve desired results. Therefore, the invention is not intended to be limited by the illustrated and described embodiment, but rather by the scope of the appended claims and the reasonable equivalents thereto.

The embodiments of the invention in which an exclusive property or privilege is claimed are defined as follows.

1. Blueberry sorting apparatus comprising:

a water bath vessel for receiving a harvested mixture of ripe and unripe blueberries; means for directing a downward current of water for entraining and immersing the mixture of ripe and unripe berries into the water bath in the vessel whereby air bubbles attenuated on the ripe berries are separated therefrom to allow ripe berries to sink further and unripe berries to rise and float; said vessel includes a berry entry zone and said water current directing means is arranged to propel water downwardly at said berry entry zone; said means for directing a downward current of water includes a diagonal deflector panel having an undersurface for directing the water current and a water outlet for causing a current of water to flow against said undersurface; and said panel having an upper surface for guiding the blueberries down to the water stream.

2. Blueberry sorting apparatus comprising: a water bath vessel having a receiving and immersion zone for receiving a harvested mixture of green, partially ripe, and ripe blueberries in the water bath; means for causing a downward current of water at said receiving and immersion zone for entraining and immersing the mixture of berries into the water bath whereby air bubbles are separated from berries to decrease their buoyancy, while green berries rise and float; a perforate conveyor in the path of said downward current to allow water flow therethrough while retaining ripe and partially ripe berries thereon; and means forming a quiescent zone in said water bath vessel, and said conveyor extending through said quiescent zone to allow partially ripe berries to rise to the bath surface and separate from the ripe berries remaining on said conveyor.

* * * * *